United States Patent [19]

Nishikawa

[11] 4,377,334

[45] Mar. 22, 1983

[54] MAGNET ROLL DEVELOPING UNIT

[75] Inventor: Masaji Nishikawa, Hachioji, Japan

[73] Assignee: Olympus Optical Company Ltd., Tokyo, Japan

[21] Appl. No.: 201,970

[22] Filed: Oct. 29, 1980

[30] Foreign Application Priority Data

Jan. 11, 1980 [JP] Japan ..... 55/1360

[51] Int. Cl.[3] ..... G03G 15/09

[52] U.S. Cl. ..... 355/3 DD; 118/685

[58] Field of Search ..... 355/3 DD, 15; 118/657, 118/658

[56] References Cited

U.S. PATENT DOCUMENTS

| | | | |
|---|---|---|---|
| 3,685,485 | 8/1972 | Kutsuwada et al. | 355/3 DD X |
| 3,909,864 | 10/1975 | Tanaka et al. | 355/15 X |
| 3,942,889 | 3/1976 | Kurita et al. | 355/15 |
| 3,965,524 | 6/1976 | Kurita et al. | 355/15 X |
| 3,999,514 | 12/1976 | Abbott et al. | 355/3 DD X |
| 4,058,086 | 11/1977 | Jugle et al. | 355/15 X |
| 4,093,368 | 6/1978 | Nishikawa | 355/15 X |
| 4,194,465 | 3/1980 | Tsukamoto et al. | 118/658 |
| 4,213,617 | 7/1980 | Salger | 355/3 DD X |

FOREIGN PATENT DOCUMENTS 2915642 10/1979 Fed. Rep. of Germany ... 355/3 DD 53-24156 9/1979 Japan .

OTHER PUBLICATIONS

*IBM Technical Disclosure Journal;* vol. 22, No. 1, Jun. 1979, pp. 28–29; "Developer's Electromagnetic Gate", by R. A. Daniels.

*Xerox Disclosure Journal;* vol. 1, No. 4, Apr. 1976, pp. 73–74; "Toner Emission Control Concept" by John T. Bickmore.

*Primary Examiner*—G. Z. Rubinson

*Assistant Examiner*—Keith E. George

*Attorney, Agent, or Firm*—Weinstein & Sutton

[57] ABSTRACT

A developing unit comprises a guide vane mounted on a portion of the housing which defines a developing opening and disposed for contact with the free end of a developer brush which is formed by a conveying magnetic pole, and a vent formed in the housing at a location removed from the opening. The guide vane cooperates with the brush which moves during the rotation of a non-magnetic sleeve to provide an air pump action, which draws the air containing the toner in suspension into the closed housing of the developing unit from the region of the opening while the vent acts to reduce the internal air pressure within the housing which tends to increase as a result of the air pump action.

14 Claims, 7 Drawing Figures

MAGNET ROLL DEVELOPING UNIT

BACKGROUND OF THE INVENTION

The invention relates to a magnet roll developing unit which may be used in an electrophotographic apparatus or electrostatic printing machine, and more particularly, to a magnet roll developing unit including a rotating sleeve and utilizing a magnetic developer, such as a two component developer formed by a mixture of a carrier in the form of magnetic powder and a toner, a two component magnetic toner developer formed by a toner including magnetic powder and another powder which enables a triboelectric charging, or a single component magnetic developer formed by a toner including magnetic powder, and wherein the developer is conveyed to a developing, magnetic pole where a magnetic brush is formed for supplying a toner to a surface to be developed.

A conventional magnet roll developing unit including a rotating sleeve which is extensively used in the art of electrophotographic apparatus is constructed as illustrated in FIG. 1. As shown, a magnet roll developing unit 1 is disposed adjacent to a photosensitive drum 2 which carries thereon an electrostatic latent image formed by a well known electrophotographic process. The drum 2 is adapted to rotate in a direction indicated by an arrow a and carries a surface which is to be developed. The developing unit 1 is adapted to bring a magnetic developer 3, formed by a two component magnetic developer, for example, into contact with the surface of drum 2 to develop the latent image with toner.

The developing unit 1 includes a housing 4 which is formed with a developing opening 5 in the region adjacent to the drum 2. A magnet roll 6 carrying a developing magnetic pole $N_1$ and a plurality of conveying magnetic poles $N_2$, $S_1$, $S_2$ and $S_3$ is fixedly mounted within the housing 4 at a given spacing from the drum 2 so as to be located opposite thereto through the opening 5. A cylindrical sleeve 7 of a non-magnetic material such as aluminium is disposed in closely spaced and surrounding relationship with the outer periphery of the magnet roll 6, and can be driven for rotation in a direction indicated by an arrow b, by suitable drive means, not shown. The housing 4 contains a quantity of magnetic developer 3, in which substantially the lower one-half of the non-magnetic sleeve 7 is immersed, whereby the developer 3 is subject to the influence of magnetic lines of force from the magnet roll and passing through the non-magnetic sleeve 7, whereby it is retained on the sleeve 7 in laminar form. As the sleeve 7 rotates in the direction of the arrow b, the developer 3 retained thereon is simultaneously conveyed in the same direction with substantially the same surface speed, and an excess amount of developer is scraped off by a doctor blade 8, disposed adjacent to a region between the conveying pole $S_2$ and the developing pole $N_1$ so as to provide a given thickness of the developer layer before the latter acts on the drum 2. Subsequently, the developer conveyed is formed into a magnetic brush in the form of a tuft in the region of the developing pole $N_1$, which brush is brought into sliding contact with the drum 2 to develop the electrostatic latent image thereon.

After the developing step has been completed, the developer is scraped off the sleeve 7 by means of a scraper 9 which is disposed adjacent to an area of the magnetic roll where no magnetic pole is present. The developer removed from the sleeve 7 is returned into the supply of initial developer where it is agitated by the rotation of agitating blades 10 to form a uniform mixture, which is again attracted to and retained on the non-magnetic sleeve 7, thus cycling through the circulation path mentioned above.

A hopper 11 which contains a replenishing supply of toner is disposed in the top portion of the housing 4, which is thus formed substantially as an enclosed structure. The hopper 11 is formed by a partition plate 12 secured to one sidewall of the housing 4 and a vibrating plate 13 which is formed by a resilient plate. The lower ends of these plates are spaced apart to define an outlet where a toner supply roller 14 is mounted for rotation at a given speed in interlocked relationship with the rotation of the sleeve 7. The toner supply roller 14 is formed with a notch 14*a* which is utilized to provide a replenishing supply of the developer 3 into the bottom of the housing 4 from the quantity of toner 15 contained within the hopper 11. During the rotation of the roller 14, the lower end of the vibrating plate 13 engages the notch 14*a* to permit an incremental quantity of toner which is just received within the notch 14*a* to be supplied into the developer 3, thus maintaining a desired mixture ratio of the toner and the magnetic carrier.

In the region of the conveying poles $S_3$, $N_2$ and $S_2$, which are completely embedded into the supply of developer 3, no tuft-shaped magnetic brush is formed, but a magnetic brush in the form of a tuft is formed by the developer in the region of the magnetic poles $N_1$ and $S_1$ which are located above the supply of developer 3. In such region, as the developer moves while maintaining its tuft configuration, the inertia thereof causes the developer to be scattered into the air against the influence of the magnetic force. In case of a two component magnetic developer formed by a mixture of iron powder, serving as a carrier, and a toner, the carrier will be scattered, and at the same time the toner will be separated from the carrier to be suspended in the air. In the region of the developing pole $N_1$ where the drum 2 is located opposite to the brush shaped as a tuft and where the height of the brush is controlled, the scattering of the toner and carrier is at a relatively low level. However, in an experiment conducted by rotating the non-magnetic sleeve 7 while removing the photosensitive drum 2, it is found that the scattering of the carrier and toner increases to a substantially higher level. It is also found that the occurrence of scattering tends to be reduced for a reduced spacing between the drum 2 and the sleeve 7 with a reduced height of the brush, and tends to increase as the spacing increases to cause an increased height of the brush.

Since the region of the conveying pole $S_1$ is normally exposed in the air, there occurs an increased level of scattering of the toner and carrier. However, since such region is located within the housing 4, the majority of the carrier and toner scattered can be confined to this portion of the housing, with a minimized amount of toner alone being allowed to be scattered outside the housing 4. The toner scattered from the region of the poles $N_1$, $S_1$, though reduced in quantity, will find its way out of the developing unit 1 as a result of it being carried by an airstream which occurs in a direction indicated by broken line arrows c, causing a contamination of the interior of an electrophotographic apparatus. The degree of contamination, as accumulated over a prolonged period of use, will reach a significant level, giving rise to a number of interferences. If the proportion of the toner in the developer 3 increases for some reason, the degree of scattering of the toner will increase substantially, considerably marring the interior of an electrophotographic apparatus in a reduced period of time.

Considering the cause of occurrence of the airstream indicated by broken line arrows c in FIG. 1, it will be noted that a laminar flow along the drum surface which occurs as a result of rotation of the drum 2, another laminar flow which occurs along the surface of the developer layer of the sleeve 7 and moving in a direction indicated by the arrow b, and an air current which is caused as the tuft-shaped brush is formed in the air in the region of the magnetic poles $N_1$, $S_1$ prevail in a space adjacent to the developing pole $N_1$. It will be understood that the laminar flow along the drum 2 exhibits a current speed which increases toward the drum surface and which is substantially equal to the peripheral speed of the drum 2 on the drum surface. However, the laminar flow along the drum surface is interrupted in the region of the developing pole $N_1$ by the presence of the developing brush, and an air current containing scattered toner is caused by the formation of the developing brush which tends to flow upwardly together with the laminar flow moving along the outer extremity of the developer layer. The laminar flow which flows along the outer surface of the developer layer is once received into the housing 4, but as a result of an increased internal pressure of the housing 4, it is driven externally of the housing 4 through the opening 5, thus causing the air current indicated by the broken line arrows c. To summarize, it will be seen that the presence of a projecting portion such as the brush formed on the magnetic pole $S_1$ causes the air current to be created which tends to flow from the interior of the housing 4 toward the opening 5 to scatter a quantity of toner from the brush formed on the magnetic pole $S_1$ as well as from the suspension of toner formed within the housing 4.

To eliminate the above disadvantage, there has been proposed a variety of developing units. In one unit, a shielding member is provided to block the clearance region between the developing unit and the photosensitive drum. In another unit, an electrode plate which catches the developer is disposed to trap the suspension of toner thereon with the application of a voltage thereto. In a still further unit, the air is withdrawn from the interior and from the opening of the housing to remove suspended toner. In an additional unit, the opening of the housing is provided with a filter so that an airstream produced introduces an air current containing the suspension of toner into the housing to filter it. However, all of these conventional developing units are unsatisfactory in providing a satisfactory prevention of contamination or marring by the scattered toner, and are bulky and complex in their overall arrangement.

SUMMARY OF THE INVENTION

It is an object of the invention to eliminate above disadvantages of the prior art, by providing a magnet roll developing unit which is adapted to prevent effectively a contamination or marring of the surrounding parts around the developing unit by the scattered toner, with a simple arrangement.

In accordance with the invention, a guide vane is disposed adjacent to the tip or free end of a developer brush in the form of a tuft which is formed on a conveying pole $S_1$ which immediately follows a developing pole $N_1$, as viewed in the direction of rotation of a non-magnetic sleeve. The guide vane cooperates with the brush to provide an effective partitioning of the housing from a developing opening, which is formed adjacent to the developing pole, and to provide an air pump action which is produced as the brush moves with the rotation of the non-magnetic sleeve to force the air occupying a region adjacent to the opening of the housing and containing a suspension of toner. As a result, a contamination or marring which might otherwise occur as a result of the scattering of toner in a region adjacent to the opening is effectively prevented.

An air vent is provided in the housing to reduce the internal air pressure within the housing which tends to increases as a result of the air pump action. Consequently, the toner which is contained in suspended form in the effluent air through the air vent is positively caught by toner removal means which is disposed in the vent, thus preventing a marring of the interior of the electrophotographic apparatus by the scattered toner.

DESCRIPTION OF PREFERRED EMBODIMENTS

Figure 1:
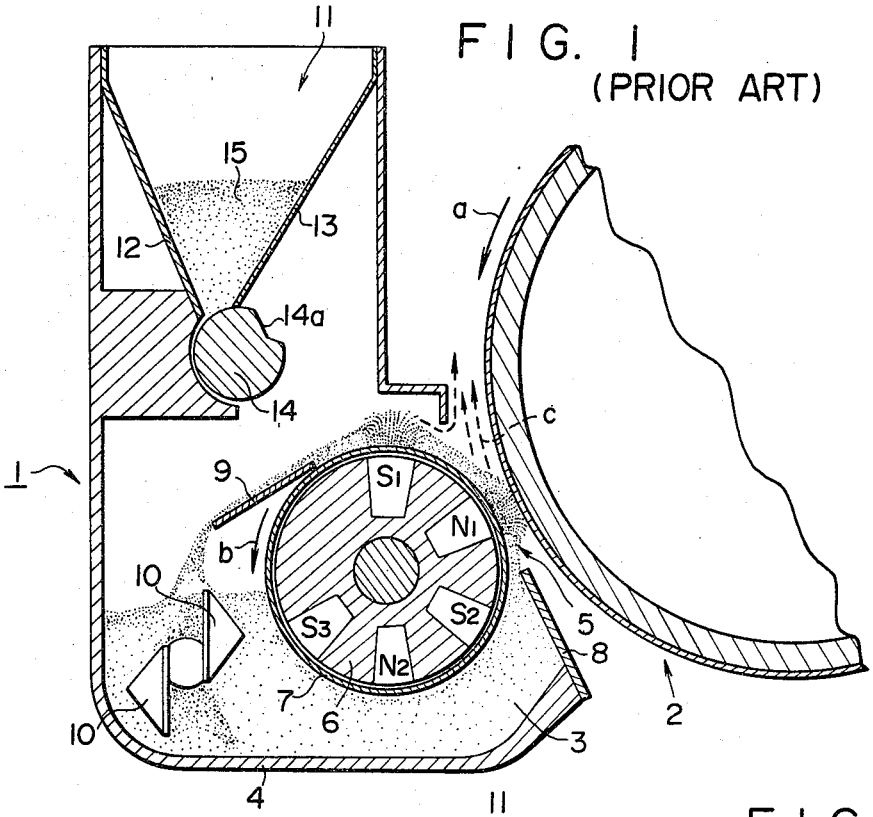
FIG. 1 (PRIOR ART)
FIG. 1 is a cross section of a conventional magnet roll developing unit.
Figure 2:
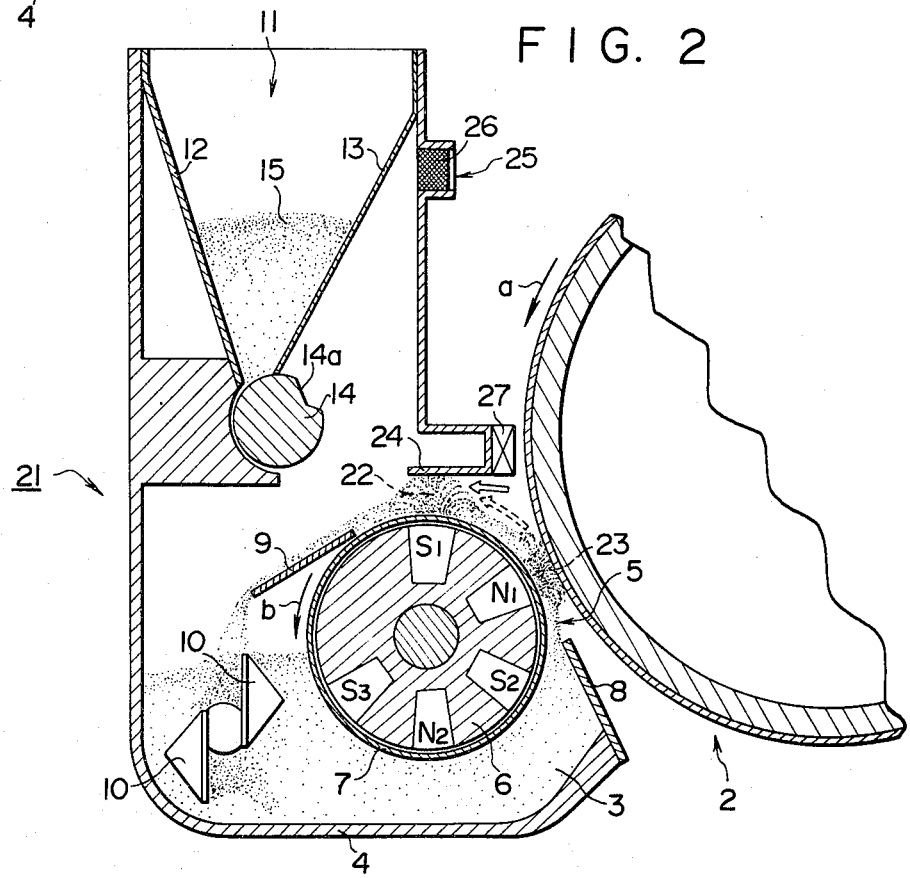
FIG. 2 is a cross section of a magnet roll developing unit according to one embodiment of the invention.

Referring to FIG. 2, there is shown a magnet roll developing unit 21 according to the invention. The unit 21 is similar to the conventional developing unit 1 shown in FIG. 1 except that a guide vane 24 is disposed, as an integral extension from part of a housing 4 which defines a developing opening 5 or as a separate member, for contact with or close to the free end of a developer brush 22 which is defined in the form of a tuft by a conveying magnetic pole $S_1$, that a vent 25 is formed in the housing 4 at a location remote from the opening 5, and that a toner trapping filter 26 is disposed in the vent 25. Accordingly, the remaining components functioning in the same manner as in the arrangement of FIG. 1 are designated by like numerals as used with corresponding parts shown in FIG. 1, and therefore will not be described.

In the present embodiment, the guide vane 24 is secured to one edge of the developing opening 5 formed in the housing 4, and extends inward into the housing 4. The guide vane is located so that the free end of the developer brush 22 formed by the conveying pole $S_1$ moves in sliding contact with the lower surface of the vane. The vent 25 is formed in a top portion of a sidewall of the housing 4 which is located opposite to the drum 2 in order to release the increased air pressure within the housing 4. The toner trapping filter 26, which is one of toner removal means to be described later, is disposed in the vent 25. It will be appreciated that the filter 26 serves the purpose of trapping toner contained in suspended form in the effluent air through the vent 25, thus preventing the suspended toner from being scattered externally of the developing unit 21. The provision of the guide vane 24 permits one side of the opening 5 to be closed by the developer brush 22 defined on the pole $S_1$ while the other side of the opening 5 is closed by a quantity of developer which fills in the space between a sleeve 7 and a doctor blade 8 which controls the thickness or height of a developer layer retained on the non-magnetic sleeve 7. Consequently, the interior of the housing 4 is completely closed from the exterior. This means that the air within the housing 4 which contains the toner in suspended form cannot find its way through the opening 5 to the exterior.

As mentioned previously, the developer brush 22 is defined on the pole $S_1$ in a manner such that its free end is in contact with or very close to the guide vane 24. As the brush 22 moves in a direction into the interior of the housing 4 during the rotation of the non-magnetic sleeve 7, it entrains surrounding air to force it into the housing 4, thus operating as an air pump. Considering this action more closely, it will be seen that as the developer is conveyed to the vicinity of the pole $S_1$, it will be formed into a tuft-shaped brush in conformity to the magnetic lines of force. The components of the brush have initially been carried to such region in closely packed condition, and when such region is approached, they begin to be rearranged into tuft form in conformity to the magnetic line of force which is erected on the sleeve 7 radially outward. The air occupies the space between the single lines of the tuft, and thus there is established a low density, dispersed array of developer containing the air. The height of the successive lines of the tuft increase until the central portion of the brush is reached with a progressively increasing amount of air trapped between these lines. However, when the central portion of the brush 22 bears against or moves close to and past the guide vane 24, the height of the single lines of the brush 22 progressively decrease until the brush is eventually collapsed. This means that the air which has been contained in the space between successive lines of the tuft is sequentially discharged. In other words, a portion of the brush which is on the near side of the central portion provides a suction of the air into the developer while a portion of the brush which is beyond or on the far side of the central portion, as viewed in the direction of rotation of the sleeve 7, provides an air discharge, whereby the developer brush effectively operates as an air pump. Since the central portion of the brush serves as a partition which substantially closes the space between the guide vane 24 and the sleeve, a flow of air other than that contained in the brush is blocked, enhancing the positiveness and the effectiveness of the air pump action. Consequently, the air containing the scattered toner in suspension and which is produced around the developing pole $N_1$ in the opening 5 can be effectively drawn into the housing 4 without causing its effluent flow out of the housing 4.

The pump action achieved by the cooperation of the developer brush 22 and the guide vane 24 is most effective when the guide vane 24 is disposed to be located at a spacing of on the order of 1 mm from the free end of the brush 22 or is located into the brush such that a length on the order of 2 mm of the brush may be reduced. However, the pump action remains effective if the guide vane 24 is spaced on the order of 2 mm from the free end of the brush 22 or if it is spaced from the sleeve 7 by a distance which is substantially equal to the distance between the doctor blade 8 and the sleeve 7.

The air current which is drawn into the housing 4 through the air pump action is exhausted through the vent 24, and the air current is utilized to trap the scattered toner by the filter 26. In this manner, the provision of the vent 25 prevents the internal air pressure within the housing 4 from being increased as a result of the air pump action, which can therefore be maintained to be effective.

While not essential, a shield member 27 may be interposed between the housing 4 and the drum 2, in the region of the opening 5, to reduce the clearance therebetween where the original clearance therebetween has an increased length, thus assuring the effectiveness of the invention. This is because the air pump action produced by the cooperation of the developer brush 22 and the guide vane 24 has a capacity which is sufficient to assure a reliable pump action for an increased length of the clearance to withdraw an amount of air which is necessarily introduced into the opening 5 as a result of the rotation of the drum 2 and of the movement of the developer, but which may be insufficient to provide a complete withdrawal of air which freely flows through the clearance of a greater length.

It should be understood that the invention is not limited to the specific embodiment described above, but that a number of modifications and changes are possible therein. By way of example, the toner removal means which is used to trap the toner contained in an effluent airstream through the vent 25 may be constructed as shown in FIGS. 3 to 7, in addition to the trapping filter 26 mentioned above.

Figure 3:
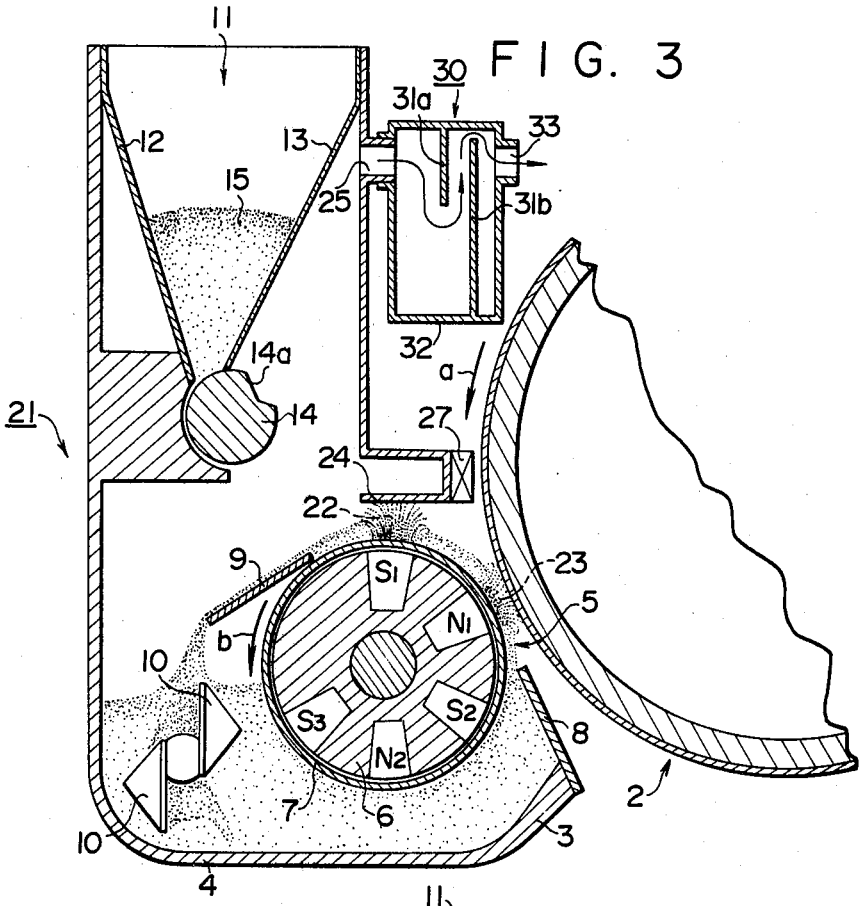
FIGS. 3 to 7 are cross sections illustrating various forms of toner removal means disposed in the vent associated with the magnet roll developing unit of FIG. 2.

FIG. 3 shows toner removal means 30 comprising a toner deposition chamber 32 having partition plates 31*a*, 31*b* therein which define a flow path like a labyrinth. The toner contained in the air in suspended form may be removed therefrom by its free fall by gravity. The toner deposition chamber 32 is formed as a hermetically sealed vessel. Because the cross sectional area of the flow path rapidly increases upon entrance into the deposition chamber 32, the air containing the toner in suspension and which passes through the vent 25 of the housing 4 has its speed reduced in a corresponding manner, whereby its residence time within the deposition chamber 32 increases. During such time, the suspended toner is gradually deposited on the bottom of the vessel by gravity while the air in the top layer of the chamber which is freed from the toner is exhausted into the atmosphere through an air exhaust port 33 formed in the chamber 32. It will be understood that the partition plates 31*a*, 31*b* provide the combined functions of causing a diffusion of the influent airstream from the vent 25 into the deposition chamber 32 and of blocking any direct current flow toward the air exhaust port 33. The toner removal means 30 in the form of the deposition chamber can be effectively operative since the amount of air which is drawn into the housing by the air pump action is relatively small.

Figure 4:
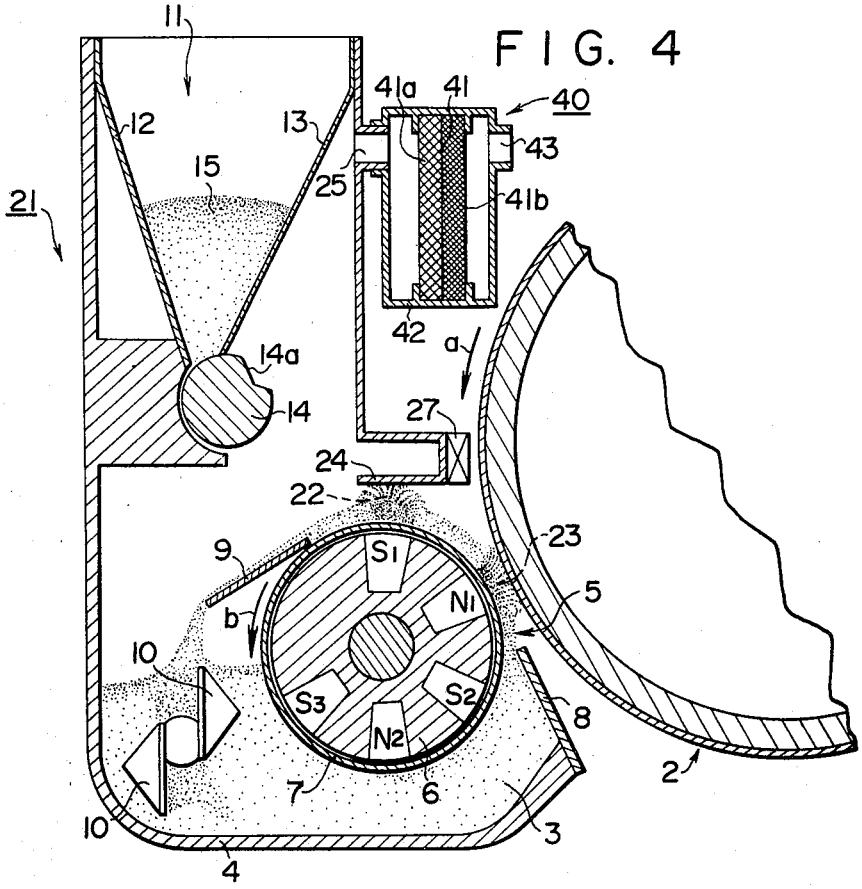

FIG. 4 shows toner removal means 40 comprising a filter box 42 having therein a filter 41 which is formed of a material such as glass wool, continuously foamed plastic or the like. The effluent air from the vent 25 and containing the toner in suspension is introduced into the filter box 42 in which the toner is removed by the filter 41, and the remaining air is exhausted into the atmosphere through an air exhaust port 42. The filter 41 may be disposed inside the housing 4 rather than being contained in the independent filter box 42 as shown. However, the use of a devoted filter box facilitates a replacement of the filter and provides a greater flexibility of design. The toner trapping capability of the filter 41 can be increased by utilizing a larger mesh filter 41*a* on the inlet side and a fine mesh filter 41b on the outlet side thereof.

Figure 5:
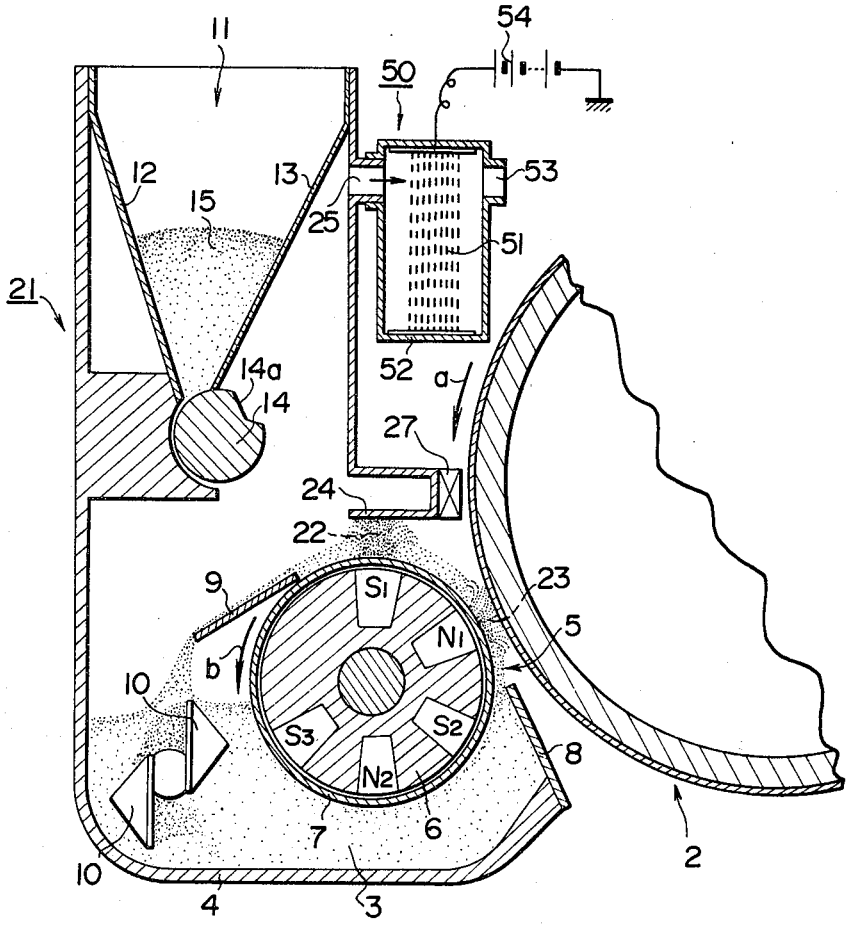

FIG. 5 shows toner removal means 50 in the form of an electrical precipitator including a plurality of conductive, mesh-shaped or plate-like trap electrodes 51 which are disposed in a closed container 52. A d.c. voltage whose polarity is opposite that of the charge on the toner is applied to the trap electrodes 51 from a power supply 54. It is desirable that the trap electrodes 51 be disposed in a multi-layer form with a air space between adjacent layers to increase the total effective surface area, thus increasing the toner trapping capability. A voltage in a range from several hundreds to several thousands volts may be applied to the trap electrodes 51 for satisfactory operation. The influent air from the vent 25 flows against the surface of the trap electrodes 51, which remove the toner therefrom, and the air is subsequently discharged into the atmosphere through an air exhaust port 53.

It is a feature of the use of the electrical precipitator 50 that the air resistance can be reduced as compared with the use of filter mentioned above and that the toner trapping capability of the toner removal means can be increased with a reduced size because an increased number of layers of the trap electrodes 51 can be used.

Figure 6:
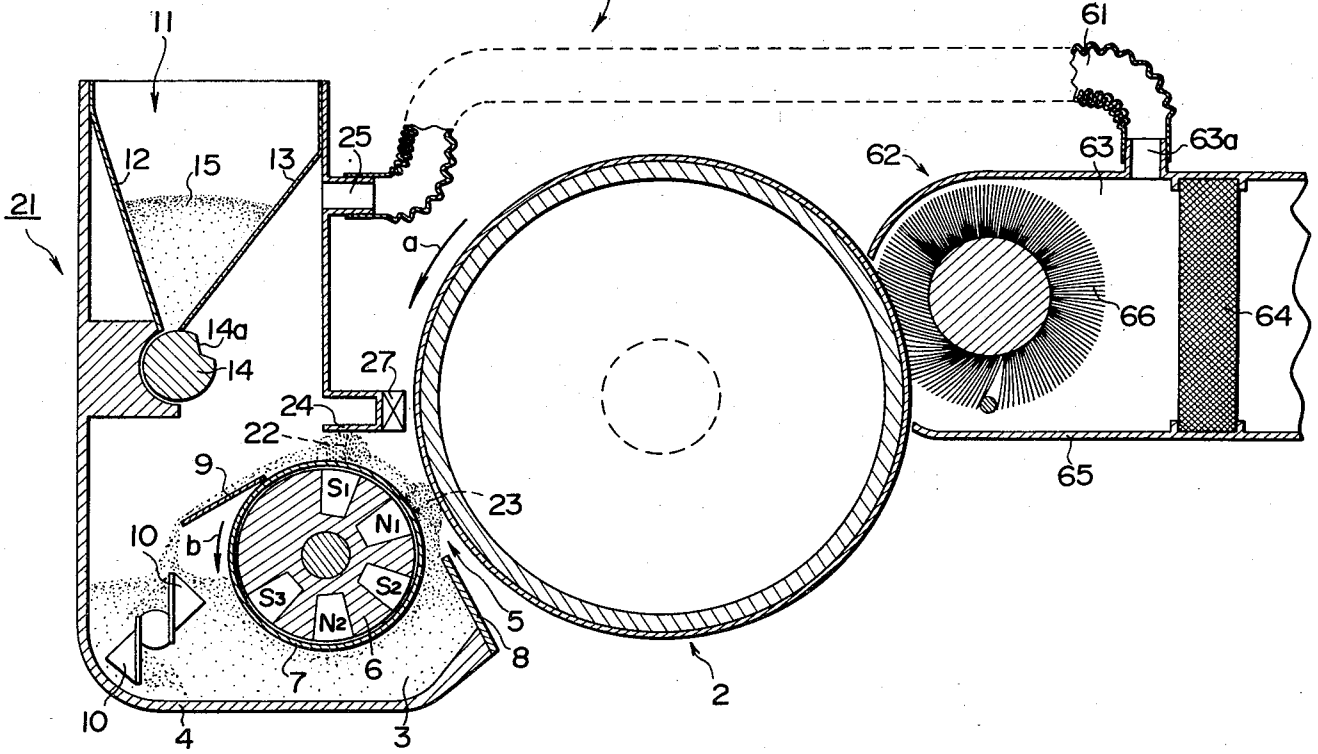

FIG. 6 shows another form of toner removal means 60 comprising a duct 61 which is connected between the vent 25 of the housing 4 and an inlet port 63a of a negative pressure chamber 63 of brush-type cleaning unit 62 which is originally provided to clean the drum 2 of the electrophotographic apparatus. The cleaning unit 62 includes a filter 64, which removes the air-borne toner carried by the effluent air from the vent 25. With such toner removal means, the simple provision of the duct 61 is all that is required to trap the toner, thus dispensing with a separate toner removal means and facilitating maintenance of the unit.

As is well recognized, the brush-type cleaning unit 62 includes a housing 65 in which are received the cleaner filter 64 and a cleaner brush 66 which is disposed for contact with the drum 2. A negative pressure chamber as shown at 63 is defined within the housing 65 by suction means, not shown. Accordingly, the inlet port 63a of the negative pressure chamber 63 is effective to provide an air suction. On the other hand, a pressure greater than the atmospheric pressure prevails in the interior of the housing 4, so that an effluent air flow is automatically established through the vent 25 to add to the air suction provided by the negative pressure chamber 63. Hence, a duct of a relatively small diameter and having an increased length can be used as a duct 61 with satisfactory result.

Figure 7:
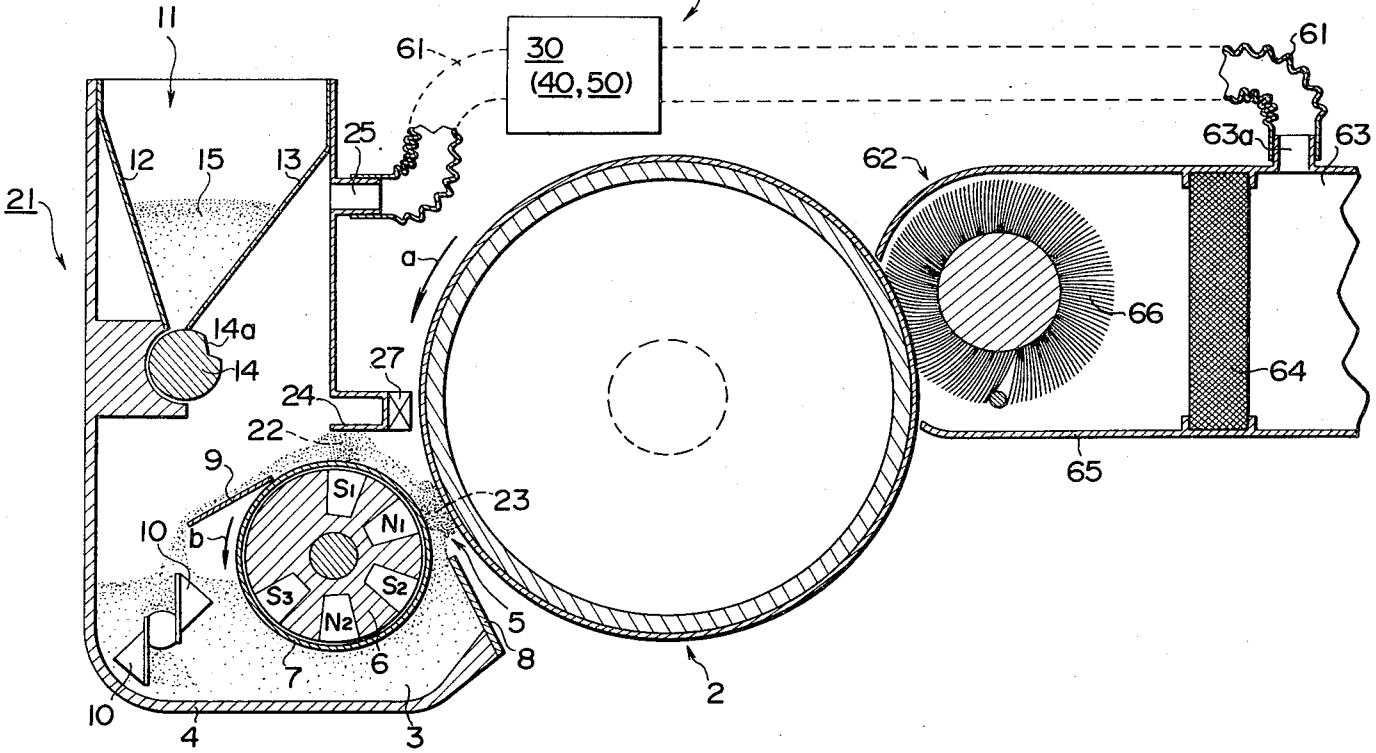

FIG. 7 shows toner removal means 70 which is similar to the arrangement shown in FIG. 6 but in which any one of the toner removal means 30, 40 or 50 shown in FIGS. 3 to 5 is disposed at an arbitrary location within the duct 61 extending from the vent 25 to the inlet port 63a. Such a combination of toner removal means is effective to avoid a degradation in its functioning over a prolonged period of use which might occur as the toner is deposited and accumulates on the bottom portion of the duct 61 in small increments. Where the toner removal means 30, 40 or 50 presents an increased air resistance, the air exhaust port 33, 43 or 53 thereof can be connected to the negative pressure chamber 63 to improve the air current characteristic.

What is claimed is:

1. A magnet roll developing unit comprising:

a closed housing containing a magnetic developer which includes a magnetic powder and a toner and having a developing opening formed therein at a location opposite to a surface to be developed;

a magnet roll fixedly mounted in the housing and carrying a developing magnetic pole and a plurality of conveying magnetic poles, said developing pole being disposed to be opposite to the surface to be developed through the developing opening;

a cylindrical, non-magnetic sleeve disposed in surrounding relationship with the magnet roll and having its lower portion immersed in a quantity of magnetic developer whih is received in the housing, said sleeve being disposed for rotation in one direction so that the magnetic developer attracted thereon by the magnetic force from the conveying poles is conveyed thereon upwardly toward the developing opening and is formed into a first tuft-shaped developer brush in the region of the developing opening under the magnetic influence of the developing pole;

a doctor blade for controlling the height of the magnetic developer layer formed and retained on the sleeve under the magnetic influence of the magnet roll as the developer enters into the developing opening;

a guide vane mounted on a member which defines one end of the developing opening being disposed close to or for contact with the free end of a second tuft-shaped developer brush formed by the magnetic field of one of the conveying poles which is located next to the developing pole, as viewed in the direction of rotation of the sleeve, said last-mentioned one of said conveying poles being arranged across from said guide vane, the guide vane guiding all toner returned to said housing to move between said guide vane and said non-magnetic sleeve and cooperating with the moving second tuft-shaped developer brush to provide an air pump action which develops a suction condition on the side of the second tuft-shaped developer brush facing the surface to be developed to draw the air containing the toner in suspension in the region of the developing opening into the housing;

the spacing between the sleeve and the guide vane causing the central portion of the second tuft-shaped developer brush to block the flow of air other than that contained in said second tuft-shaped developer brush to enhance the positiveness and effectiveness of the suction and pumping actions and to eliminate the need for additional air pumping means for said developer housing;

a vent formed in the housing for reducing the internal air pressure within the housing which internal air pressure increases as a result of the air pump action, and in order to enhance the air pump action; and toner removal means for trapping the toner which is suspended in the effluent flow moving toward and through the vent.

2. A magnet roll developing unit according to claim 1 in which the toner removal means comprises an air filter disposed in the vent.

3. A magnet roll developing unit according to claim 1 in which the toner removal means comprises a toner deposition chamber in the form of a hermetically sealed container and having partition plates disposed therein which define a flow path of a greater cross sectional area than that of the vent, thereby causing a free fall of the toner within the toner deposition chamber.

4. A magnet roll developing unit according to claim 1 in which the toner removal means comprises a filter box having a filter disposed therein which is formed of glass wool, continuously foamed plastic or the like.

5. A magnet roll developing unit according to claim 1 in which the toner removal means comprises an electrical precipitator including a closed container in which conductive, mesh-shaped or plate-like trap electrodes are disposed.

6. A magnet roll developing unit according to claim 1 in which a toner deposition chamber having an inlet communicating with said vent and an outlet, is provided with a plurality of spaced plates arranged between said inlet and said outlet and to cause the air moving between said inlet and said outlet to follow a labyrinth-like flow path.

7. A magnet roll developing unit according to claim 1, in which the guide vane is spaced two millimeters or less from the free end of the second tuft-shaped brush to thereby enhance the air pump action.

8. A magnet roll developing unit according to claim 1 in which the guide vane is spaced from the free end of the tuft-shaped brush by a distance of the order of two millimeters or less.

9. A magnet roll developing unit according to claim 1 in which the guide vane is spaced from the sleeve by a distance which is substantially equal to and no less than the distance between said doctor blade and said sleeve.

10. A magnet roll developing unit according to claim 1 in which the guide vane is spaced from the free end of the second tuft-shaped brush entering the housing by a distance equal to or less than two millimeters into the tuft-shaped brush to reduce the length of the second tuft-shaped brush.

11. A magnet roll developing unit according to claim 10 in which the guide vane is positioned relative to the free end of the second tuft-shaped brush entering the housing to reduce the length of the second tuft-shaped brush up to a maximum of two millimeters.

12. A magnet roll developing unit according to claim 1 in which the nonmagnetic sleeve rotates upwardly across the developing window, to collect developer in the lower part of the housing over the lower half of said sleeve and to return unused developer in the region of the upper part of the housing.

13. A magnet roll developing unit according to claim 1 in which the guide vane is no closer to said sleeve than the distance between said doctor blade and said sleeve; and is no further away from said sleeve than a distance which is no greater than two millimeters from the free end of the second tuft-shaped brush entering the housing.

14. A magnet roll developing unit according to claim 13 in which the positioning of the guide vane lies within a preferred range of being no further away from the free end of said second tuft-shaped brush than one millimeter; and is no closer to said sleeve than a distance sufficient to reduce the length of the second tuft-shaped brush by two millimeters.

* * * * *

UNITED STATES PATENT AND TRADEMARK OFFICE

CERTIFICATE OF CORRECTION

PATENT NO. : 4,377,334

DATED : March 22, 1983

INVENTOR(S) : Masaji Nishikawa

It is certified that error appears in the above-identified patent and that said Letters Patent is hereby corrected as shown below:

Column 4, line 17, "increases" should read -- increase --.

Column 6, line 62, "42" should read -- 43 --.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*